United States Patent [19]

Laing

[11] Patent Number: 4,561,133

[45] Date of Patent: Dec. 31, 1985

[54] JET STREAM DEVICE

[76] Inventor: Karsten Laing, 632 Marsat Ct., Chula Vista, Calif. 92011

[21] Appl. No.: 598,067

[22] Filed: Apr. 9, 1984

[30] Foreign Application Priority Data

Apr. 14, 1983 [DE] Fed. Rep. of Germany ..... 3313549
Apr. 14, 1983 [DE] Fed. Rep. of Germany ..... 3313548

[51] Int. Cl.[4] ..... A47K 3/10; E04H 3/18

[52] U.S. Cl. ..... 4/491; 4/492; 4/496; 272/26; 405/76; 405/79

[58] Field of Search ..... 4/491, 496, 488, 492, 4/501, 507, 508, 541, 542; 128/66; 272/26; 405/79, 76

[56] References Cited

U.S. PATENT DOCUMENTS

| | | | |
|---|---|---|---|
| 2,815,951 | 12/1957 | Baldanza | 272/26 |
| 3,534,413 | 10/1970 | Plasseraud | 4/492 |
| 3,605,131 | 9/1971 | Brazel et al. | 4/491 |
| 4,352,215 | 10/1982 | Laing | 4/492 |
| 4,467,483 | 8/1984 | Bastenhof | 405/79 X |

FOREIGN PATENT DOCUMENTS

| | | | |
|---|---|---|---|
| 1653760 | 11/1970 | Fed. Rep. of Germany . | |
| 1927956 | 12/1970 | Fed. Rep. of Germany . | |
| 2209507 | 9/1973 | Fed. Rep. of Germany | 4/491 |
| 2319902 | 11/1974 | Fed. Rep. of Germany . | |
| 2401040 | 7/1975 | Fed. Rep. of Germany . | |
| 2843358 | 4/1980 | Fed. Rep. of Germany | 4/491 |
| 375684 | 6/1932 | United Kingdom | 272/26 |

*Primary Examiner*—Henry K. Artis
*Attorney, Agent, or Firm*—Pennie & Edmonds

[57] ABSTRACT

A submersible jet stream device having inlet apertures and an outlet nozzle which creates a jet stream which can be located either in a first position at the water surface or a second position at a pool bottom. The device may be hinged about a horizontal position for movement between the two positions. An embodiment may include two nozzles, one at each end of a housing and two propellers on a reversible motor disposed within the housing whereby the nozzle used for the flow is determined by the direction of motor rotation.

15 Claims, 6 Drawing Figures

JET STREAM DEVICE

The invention refers to a jet stream device for swimming pools which permits a person "to swim on the spot" and alternatively can be used as a "pool sweep".

Furthermore the device can be used as a wave maker.

It is common practice to arrange nozzles in the swimming pool through which water is being expelled under high pressure. The disadvantage of such devices is based on the fact that the pump performance necessary to produce the jet stream, increases in proportion to the third power of the outlet velocity of the water jet. Therefore a conventional waterjet requires a very strong motor which uses a corresponding amount of energy. Pool sweeps are used to clean the bottom of a swimming pool by way of forcing water under high pressure through many small apertures of a water hose. Also pool sweeps require a pump with a very strong motor. Wave producing devices are presently known, but these units not only need a lot of energy but are also very complex, bulky and expensive to install.

The invention relates to devices which are located, like conventional devices, below the swimming pool water level, which can, hence, be flooded. It combines all the above mentioned functions in one unit, namely to create a jet stream, to sweep the pool on the pool-surface and to produce waves. The unit consists of a housing with a large outlet nozzle and a pump for a very high massflow but comparably small outlet velocity. The outlet velocity of a water jet is reduced to about one third the massflow. Under the above mentioned equation, if the same motor power is applied, the massflow of the device according to the invention is 27 times higher than the massflow of a conventional device. The impulse of the outlet jet is therefore, with the same motor power and electricity consumption, considerably higher than the impulse of a conventional jet stream device, because the impulse is proportional to the result of massflow times velocity. Therefore the impulse increases to a value 9 times higher than the impulse of a conventional jet stream device with the same motor peformance.

According to the invention, the device of a box-type design is equipped with a nozzle which can either be placed immediately below the watersurface or alternatively close to the bottom of the swimming pool. In the first position of the nozzle the device can be used as a jet stream generator. This is of special importance to the training of swimmers since it allows them to swim in relation to the swimming pool in one spot. On account of the great massflow the unit produces a fast moving water layer on the surface which can even be sufficiently strong to carry a waterskier. This is of great interest in the training of waterskiers. The waterskier is supported by a rope and the waterlayer on the surface moves with the same speed as a motor boat. Preferably, several devices should be arranged along one wall of the pool so that practically the whole watersurface moves with equal velocity.

A further utilization is the inducement of air into the swimming pool or into a pond.

The unit is also suited to produce waves in a swimming pool. The invention solves this problem by intermittent on- and off-switching in a frequence, depending on the size of the pool. For this purpose one or more jet stream devices will be attached to the poolwall, preferably on the shorter wall, which accelerate the water on the surface in a cyclic mode. It has been proven that through cyclic interruptions of one or more parallel running water jets, waves are created, which reach their maximum amplitude when the wavelength being formed fits once or in multiples in the pool-length in the same direction as the jet. This can be achieved through interruptions in suitable frequence. The cyclic switch is set for adjustable frequence and additionally to an adjustable on- and off-ratio within on cycle. To find the optimum condition the adaption should commence with an on- and off-ratio of approximately 1:1, then the frequence will be changed so long until the highest waves are produced and then the on- and off-ratio should be optimized.

Another mode for the activation of the waves by the jet stream device uses a pressure switch with an opening, communicating with the waterbody near the surface. The opening is installed at the end of the pool. The pressure switch acts always when the wave reaches the highest amplitude.

Furthermore the device is designed in such a way that it can produce a jet near the bottom of the pool. This stirs up the dirt on the bottom and carries this dirt into the waterbody circulated through the filter. The unit can be used for the same purpose in chemical containers or preferably in wast-water basins.

The invention will now be described, by way of example, with reference to the accompanying diagrammatic drawings, in which:

FIG. 1*a* shows a device arranged around a swivelling axis;

FIG. 1*b* shows the device in a view against the jet stream direction;

FIG. 1*c* shows the device at a 180 degrees turn;

Figures 1A, 1B, 1C:
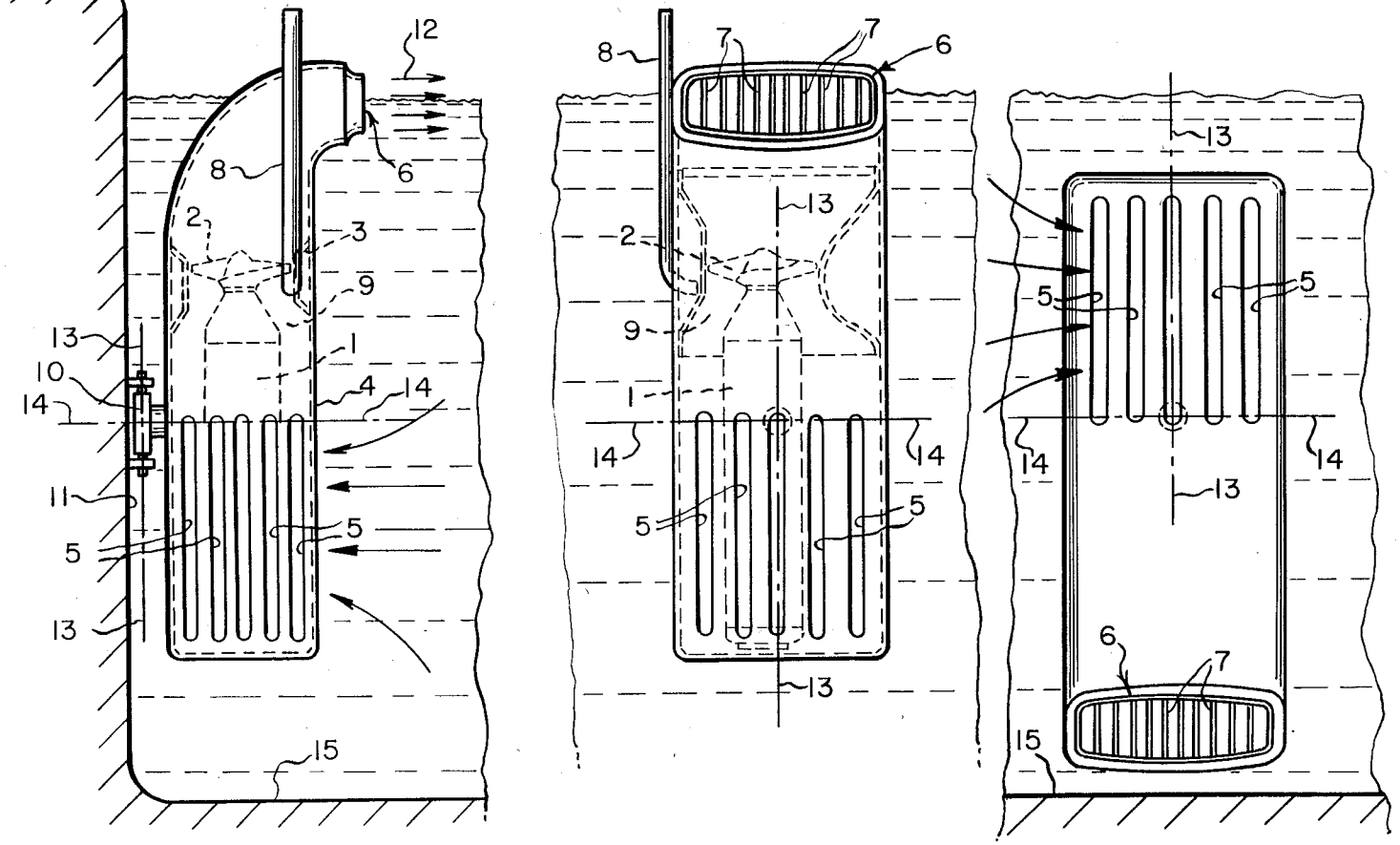

FIG. 1 shows the device in water jet position. In the box-type housing a submersible motor 1 is arrranged, which drives the propeller 2, which is situated in a flow constricting neck of the housing 4. The water enters the suction side through apertures 5 and the water outlet is formed by the wide outlet-nozzle 6 which has protecting grates 7. A pipe 8 is used to inject air. This pipe 8 ends in the contricting neck on the suction side 9 near the narrowest cross-section. By injection of air, a mixture of water and air leaves the nozzle 6. This air-containing jet can be used for massage purposes but also enrich the oxygen content of water. The device is attached on the pool-wall 11 through a hinge 10 that permits tilting around the horizontal axis 14 and the vertical axis 13.

FIG. 1*b* shows the front elevation of the device whereby the water stream enters into the housing through the apertures 5 and exits through the nozzle 6 protected by the grating 7. The cross-section surface of the nozzle has about the same surface as the cross-section of the flow constricting neck, embracing the propeller 2.

FIG. 1*c* shows the same device tilted around the horizontal axis 14. The water jet expelled near the bottom forms a boundary layer on the bottom 15 and the impulse is high enough to loosen dirt particles, so that these particles start floating in the waterbody of the pool. By movement of the device around the vertical axis 13 it is possible to sweep the whole pool bottom. In the same position the device can also be used for underwater massage. The axis of the gravity center coincides with the horizontal axis, therefore the device can be brought into any position between the positions resting in equilibrium, as shown in FIG. 1*b* and FIG. 1*c*.

Figure 2:
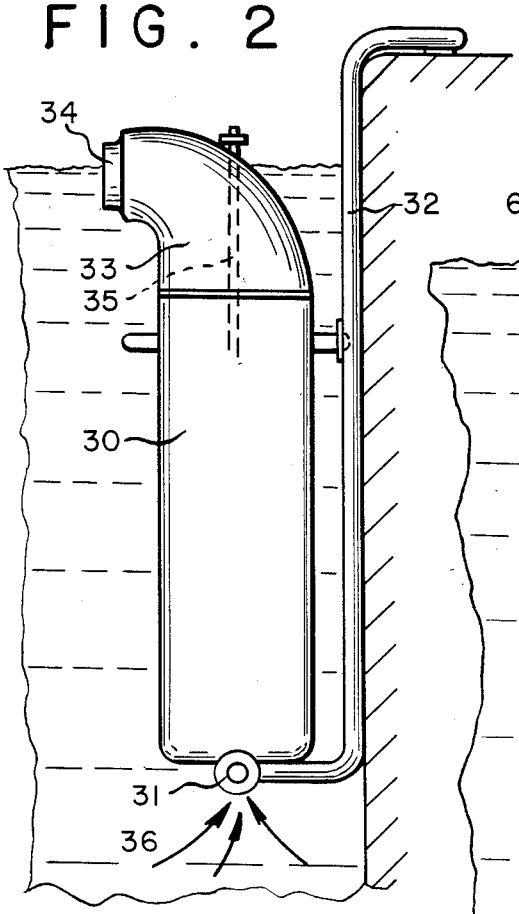
FIG. 2 shows a device with a discharge knee, which can be tilted.

FIG. 2 shows the side elevation of the device with a different fixture. For water entrance 36, the bottom of the housing has with inlet-openings. The unit has on the bottom a hinge 31 and is attached to the wall or the rim by the frame 32 made out of tubes. The discharge knee 33 with outlet-nozzle 34 is rotatible around the hinge 35.

Figure 3:
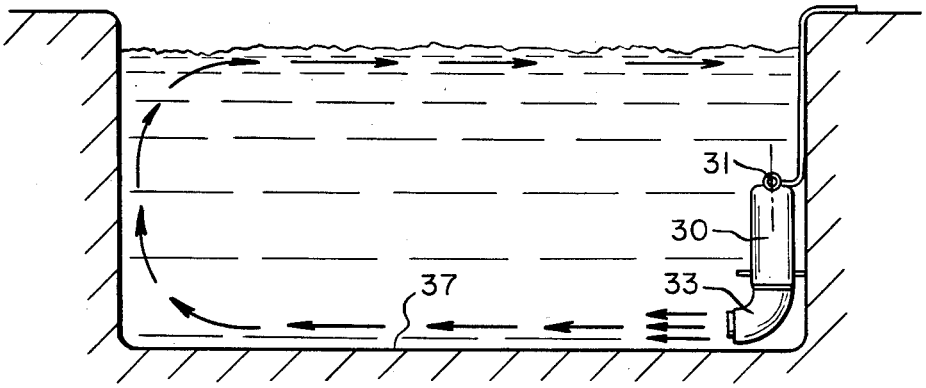
FIG. 3 shows the device of FIG. 2 in "sweeping" position.

FIG. 3 shows the same device positioned with the nozzle near the pool bottom 37. In this position the housing 30 is tilted around the hinge 31 and the discharge knee 33 is turned around a 180 degrees.

Figure 4:
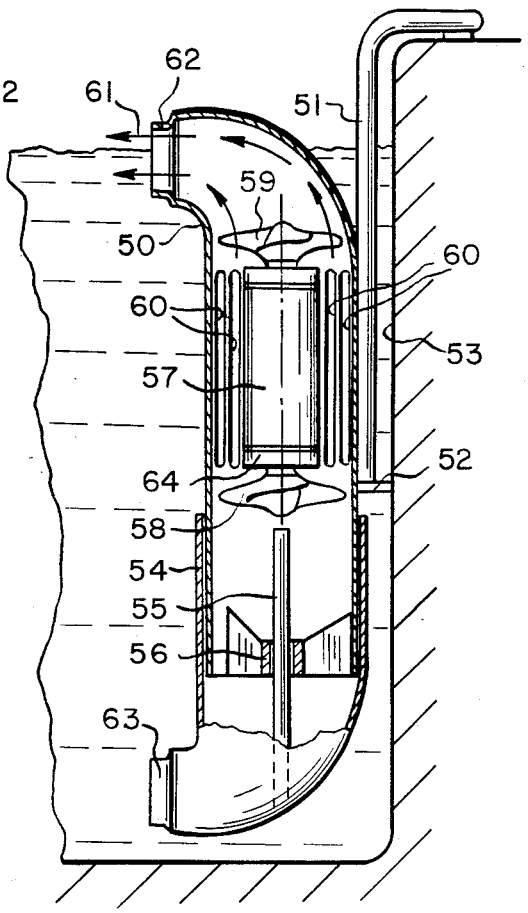
FIG. 4 shows a device with reversable motor.

FIG. 4 shows a third variant of the device with two outlet-nozzles 62 and 63. The device is installed by the frame 51 and the distance holder 52. The outlet-nozzle 62 is perpenticular to the poolwall 53 arranged, while the outlet-nozzle 63 on the bottom of the pool is pivotally attached by the bushing 56 and the shaft 55. The upper region 54 of the discharge knee is designed as a cylinder fitting around the cylindrical part of the housing of the device. The overlapping region between discharge knee and housing is adjustable to the depth of the pool. The outlet-jet through the nozzle 63 can be freely directed by rotating the discharge knee 54 around the vertical axis. The openings 60 serve as inlet-openings for the waterstream. The motor 57 drives two propellers 58, 59, each arranged on one end of the motor. If the device shall be used as a water jet with an outlet through the upper nozzle 62, the motor rotates in the first direction and the propeller 59 accelerates the water entering through the opening 60. If the device shall be used for cleaning the pool bottom the motor rotates in the opposite direction of rotation. In this position the propeller 58, arranged on the lower end of the motor, accelerates the water again entering the housing through the opening 60. The water forms a jet along the pool bottom, similar as shown in FIG. 3.

To increase the efficiency, it is advisable to use at least one overriding clutch 64 for propeller 58 and preferably a second overriding clutch for propeller 59. Such a clutch causes that only the discharging propeller is connected with the motorshaft, while the other propeller is idling.

I claim:

1. A submersible jet stream device for a swimming pool, the device comprising a longitudinally extending housing having inlet-apertures and an outlet-nozzle extending substantially at a right angle to the housing, a flow-constricting necking situated between the inlet-apertures and the nozzle, an axial impeller rotatable by an underwater motor with said impeller being situated in the necking with its axis of rotation extending parallel to the longitudinal axis of the housing, the cross-sectional area of the necking having approximately the same surface as the outlet surface of the nozzle, characterized by having means for changing the position of the outlet nozzle between a first position near the water surface and a second position close to the bottom of the swimming pool.

2. Jet stream device for a swimming pool, the device comprising a longitudinally extending housing having inlet apertures and having an outlet nozzle at one end of the housing, a flow constricting necking situated between the inlet apertures and the nozzle, an axial impeller rotable by an underwater motor with said impeller being situated in the necking with its axis of rotation extending parallel to the longitudinal axis of the housing, the cross-sectional area of the necking having approximately the same surface as that of the outlet surface of the nozzle, characterized by a submersible housing, and means for pivoting the housing around a horizontal axis located approximately along half the height of the water level in the pool, so that the outlet nozzle in a first position is located near the water surface and in a second position is located near the bottom of the pool.

3. Jet stream device for a swimming pool, the device comprising a longitudinally extending housing having inlet-aperture and having an outlet-nozzle at one end of the housing near the water surface, a flow constricting necking situated between the inlet-apertures and the nozzle, an axial impeller rotable by an underwater motor with said impeller being situated in the necking with its axis of rotation extending parallel to the longitudinal axis of the housing, the cross-sectional area of the necking having approximately the same surface as that of the outlet surface of the nozzle, characterized in that means are provided for rotating the motor in either direction, that a second outlet nozzle is situated at the other end of the housing near the pool bottom, and there is a second propeller mounted on the shaft of said motor in a necking between the inlet apertures and the second outlet nozzle such that reversing the motor causes the jet stream to exit one of the other of said nozzles.

4. A device according to one of the claims 2 or 3, whereby the motor is controlled by a switch permitting cyclic operation of a predetermined frequence.

5. A device according to claim 4, further including means to control the ratio between operation and standstill.

6. A device according to claim 4, whereby a through water pressure operated switch interrupts the current driving the motor when a wave reaches a poolwall.

7. A device according to claim 2, whereby a hinge with a horizontal axis is attached on the bottom of the device and fixed with a suspension attachment.

8. A device according to claim 7, whereby the part of the housing between the motor propeller unit forms a tiltable discharge knee together with the outlet nozzle, tiltable about a vertical axis.

9. A device according to claim 3, whereby the motor can be reversed and the housing having two outlet-nozzles, one near the water surface and the second one near the pool bottom.

10. A device according to claim 9, whereby the motor is equipped with one propeller on each end and the inlet apertures are arranged between the two propellers.

11. A device according to claim 9, whereby the lower nozzle is tiltable about a horizontal axis.

12. A device according to claim 11, whereby the upper part of the discharge knee of the lower nozzle overlaps the lower part of the housing and has means permitting adjustment of the distance between the upper and the lower nozzle.

13. A device according to claim 10, whereby an overriding clutch is arranged between the motor and at least one of the propellers.

14. A device according to claim 2, whereby the housing is fixed to the wall or the rim of the swimming pool by suspension means, tiltable about a horizontal axis penetrating the center of gravity.

15. A device according to claim 14, whereby the outlet nozzle is also tiltable about a vertical axis.

* * * * *